US007959466B2

(12) United States Patent
Ju

(10) Patent No.: US 7,959,466 B2
(45) Date of Patent: Jun. 14, 2011

(54) INDIVIDUALLY FILTERED TERMINALS AND SHIELDED CIRCUIT BOARD THROUGH-HOLES

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 149 days.

(21) Appl. No.: 12/318,603

(22) Filed: Dec. 31, 2008

(65) Prior Publication Data

US 2009/0111325 A1 Apr. 30, 2009

Related U.S. Application Data

(63) Continuation-in-part of application No. 11/832,231, filed on Aug. 1, 2007, now abandoned.

(51) Int. Cl.
*H01R 13/648* (2006.01)

(52) U.S. Cl. ..... 439/607.03

(58) Field of Classification Search ..... 439/607.03, 439/607.05, 607.1
See application file for complete search history.

(56) References Cited

U.S. PATENT DOCUMENTS 4,494,092 A * 1/1985 Griffin ..... 333/182
5,257,949 A * 11/1993 Paulus ..... 439/620.1
5,480,309 A * 1/1996 Arisaka ..... 439/43
6,388,208 B1 * 5/2002 Kiani et al. ..... 174/266

* cited by examiner

*Primary Examiner* — Edwin A. Leon
*Assistant Examiner* — Vanessa Girardi
(74) *Attorney, Agent, or Firm* — Rosenberg, Klein & Lee

(57) ABSTRACT

An electrical connector includes an insulating body, a plurality of terminals, a plurality of shielding layers, and a plurality of insulating layers. The insulating body has a plurality of terminal-receiving holes. The shielding layers are mounted on the terminal-receiving holes. The insulating layers are mounted on the shielding layers, and the terminals are disposed in the terminal-receiving holes. Thereby, the insulating layers prevent EMI between terminals and ensure the terminals do not contact the shielding layers.

9 Claims, 3 Drawing Sheets

INDIVIDUALLY FILTERED TERMINALS AND SHIELDED CIRCUIT BOARD THROUGH-HOLES

CROSS REFERENCE TO RELATED APPLICATION

This application is a continuation-in-part of U.S. application Ser. No. 11/832231, filed on 1 Aug. 2007 and entitled "electrical connector", now abandoned.

BACKGROUND OF THE INVENTION

1. Field of the Invention

The present invention relates to an electrical connector, and in particular to an electrical connector having a shielding layer for preventing EMI (Electromagnetic Interference).

2. Description of the Prior Art

As computer and digital technology have advanced, the need for products to transmit data faster has been constant. To obtain the high data transmission speed, there are a number of electrical connectors with high terminal density available on the market such as LGA (Land Grid Array) connector. However, how to protect the transmission of data from EMI is an issue in the development of high terminal density technology. The ordinary method for preventing EMI is to install a layer of a metal or set a plated film on the surface of the insulating body to improve the quality of EMI protection. However, because the metal layer is only disposed on the surface of the insulating body, the influence of EMI between terminals to the properties of electrical connector are also huge when the electrical connectors have the high terminal density, thereby it reduces the ability of the electrical connector to transmit signals. In view of this, the inventor proposes the present invention to overcome the above problems.

SUMMARY OF THE INVENTION

An object of the present invention is to provide an electrical connector that reduces EMI efficiently between terminals and prevents the terminals from contacting the shielding layers that are disposed in the plurality of terminal-receiving holes.

In order to achieve the above object, the present invention provides an electrical connector which comprises an insulating body, a plurality of terminals, a plurality of shielding layers, and a plurality of insulating layers. The insulating body has a plurality of terminal-receiving holes. The shielding layers are mounted on the terminal-receiving holes. The insulating layers are mounted on the shielding layers, and the terminals are disposed in the terminal-receiving holes.

In order to achieve the above object, the present invention further provides and electrical connector which comprises an insulating body, a plurality of terminals, a plurality of insulating lumps. The insulating body has a plurality of terminal-receiving holes. Each of the insulating lumps has a fixing hole and the terminal is fixed therein. A plurality of shielding layers for preventing EMI and preventing contacting the terminals are mounted on the outer of the insulating lumps. The insulating lumps with the terminals are disposed in the terminals-receiving holes. The insulating lump is between the shielding layer and the terminal.

The advantages of the present invention lie in that the shielding layers are mounted on the insulating body and the insulating layers are mounted on the shielding layers, thereby reducing EMI between terminals and preventing the terminals from contacting the shielding layers in the terminal-receiving holes. By preventing EMI and static electricity the present invention also prevents the terminals from grounding and contacting each other. As a result, the stability of the electrical connector is improved, the structure is simple, and the cost is reduced.

DETAILED DESCRIPTION OF THE INVENTION

Figure 1:
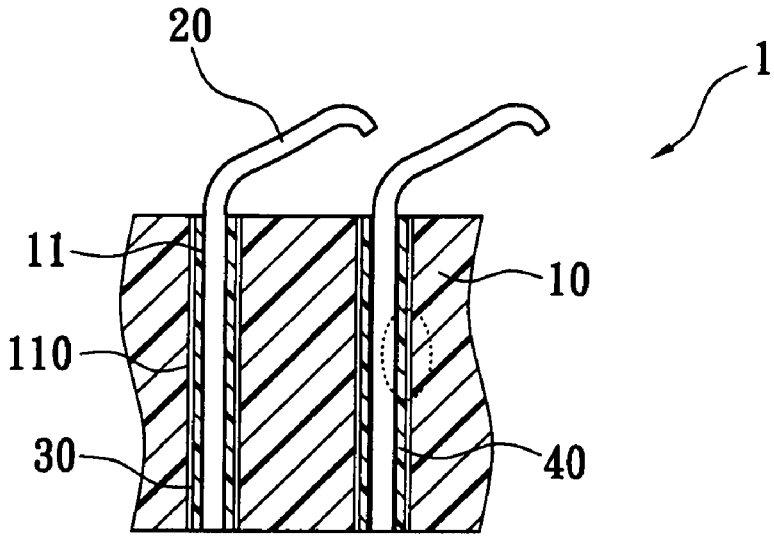
FIG. 1 is a cross-sectional view showing a portion of the electrical connector of the present invention.
Figure 2:
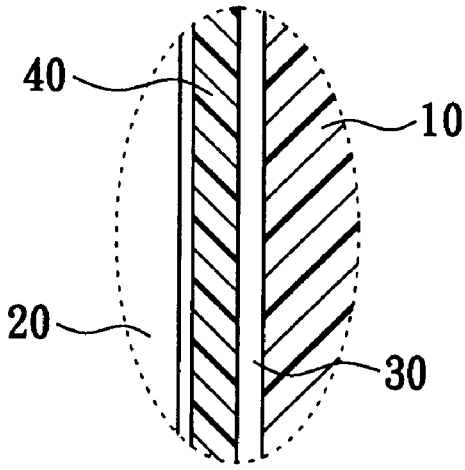
FIG. 2 is an enlarged perspective view showing a portion of the electrical connector of the present invention.

Please refer to FIG. 1 and FIG. 2, in which the present invention of an electrical connector 1 is shown. The electrical connector 1 includes an insulating body 10 and a plurality of terminals 20. The insulating body 10 has a plurality of terminal-receiving holes 11 and the terminals 20 are set in the terminal-receiving holes 11. A plurality of shielding layers 30 are attached to an inner wall 110 of each of the terminal-receiving holes 11. The shielding layers 30 can prevent crosstalk that occurs due to the near gap of the terminals 20. A plurality of insulating layers 40 that are covered with and attached to the shielding layers 30 prevent the terminals 20 from contacting the shielding layers 30.

The shielding layers 30 that are disposed around the terminal-receiving holes 11 and correspond to the shape of the terminal-receiving holes 11 can be metal housings. The shielding layers 30 also can be metal films plated to the inner wall 110 of the terminal-receiving holes 11 by using a vacuum sputtering or a coating method. The shielding layers 30 that are attached to the inner wall 110 of the terminal-receiving holes 11 can further be foil made of good ductility metal.

The shielding layers 30 are covered with the insulating layers 40. The insulating layers 40 can be plastic housings or formed on the shielding layers 30 by molding. The insulating layers 40 also can be insulating coatings applied to the shielding layers 30. Furthermore, the insulating layers 40 can be plastic films that are attached to the shielding layers 30, thereby preventing the terminals 20 from contacting the shielding layers 30.

Figure 3:
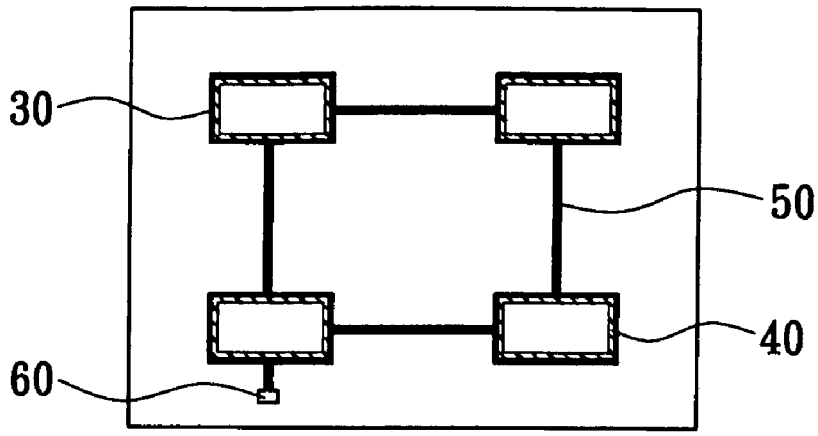
FIG. 3 is an enlarged perspective view of the top view showing a portion of the electrical connector while the terminals are uninstalled therein of the present invention.
Figure 4:
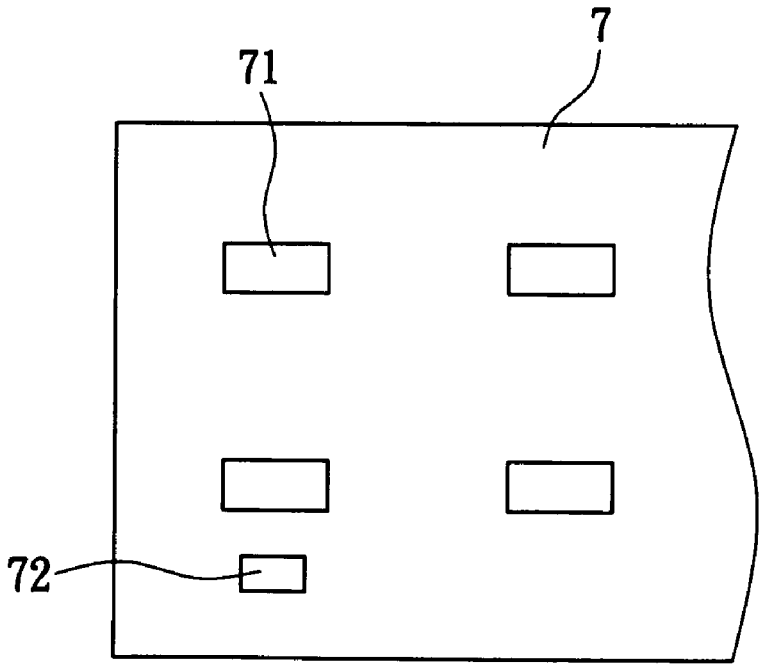
FIG. 4 is an enlarged perspective view showing a portion of the circuit board connected to electrical connectors of the present invention.

Please refer to FIG. 3 and FIG. 4, the electrical connector 1 connects to a circuit board 7. Furthermore, the electrical connector includes a conductive layer 50 that is electrically connected to the shielding layers 30 in the terminal-receiving holes 11. The circuit board 7 has a contact pad 71 and a grounding circuit 72. The conductive portion 50 is connected to a grounding circuit 72 of the circuit board via a conductive sheet 60; therefore the shielding layers 30 are electrical connected with the grounding circuit 72 of the circuit board 7.

The present invention prevents the terminals 20 from contacting the shielding layers 30 and prevents signal failure via the insulating layers 40 that are mounted on the shielding layers 30. The stability of the electrical connector 1 is improved.

Figure 5:
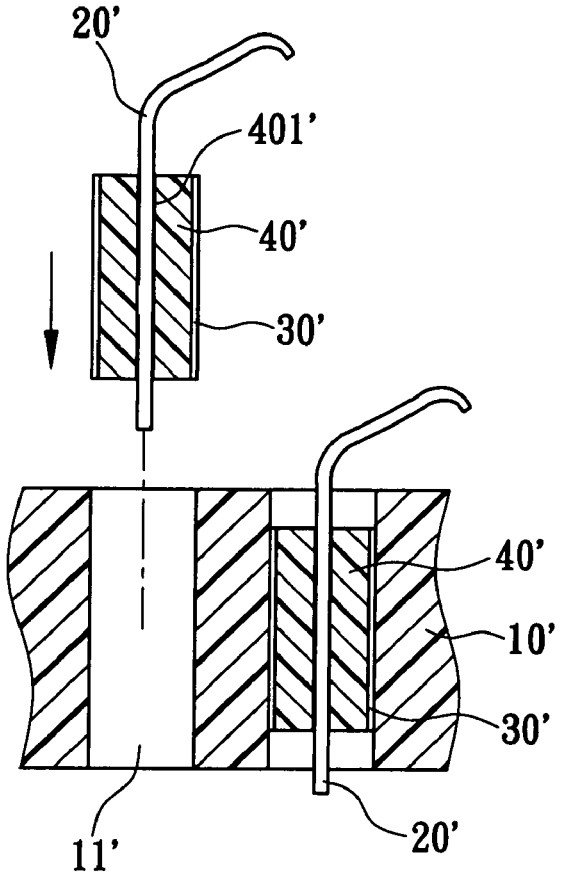
FIG. 5 is an enlarged sectional view showing another embodiment of the present invention.
Figure 6:
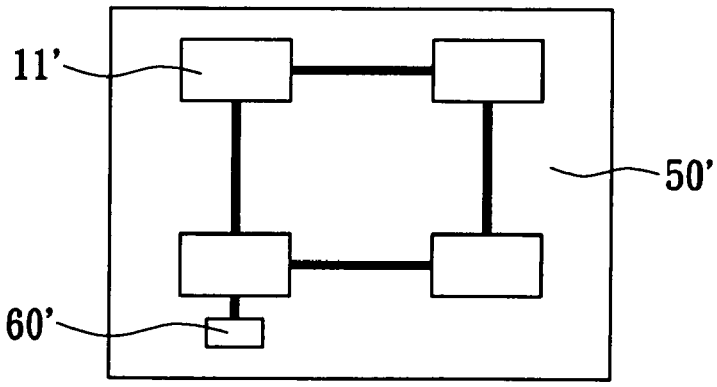
FIG. 6 is an enlarged perspective view showing electrical connector with no terminals and insulating lumps of the present invention.

Please refer to FIG. 5, it shows another embodiment of the present invention. The electrical connector includes a insulating body 10'. The differences between the embodiment with the above embodiment are that there is no metal layer planed in the terminal-receiving holes 11'. The electrical connector includes a plurality of insulating lump 40'. Each of the insulating lumps 40' has a fixing hole 401'. The terminals 20' are set and fixed in the fixing holes 401'. A plurality of shielding layers 30' for preventing EMI and preventing contacting the terminals 20' are mounted on the outside of the insulating lumps 40'. The shielding layers 30' are plated on the outside of the insulating lumps 40' by using a vacuum sputtering or a coating method. But the methods need not to limit to the above. The shielding layers 30' can be metal housings covered the outside of the insulating lumps 40'. The shielding layers 30' also can be metal foils adhered to the outside of the insulating lumps 40'. Further, the shielding layers 30' can be metal films plated on the outside of the insulating lumps 40'. The insulating lumps 40' with terminals 20' are disposed in the terminal-receiving holes 11'. The insulating lump 40' is between the shielding layer 30' and the terminal 20'. A conductive layer 50' is disposed at the bottom of the electrical connector and electrically connected the shielding layers 30' in the terminal-receiving holes 11' (while the insulating lumps 40' and the terminals 20' set in the terminal-receiving holes 11'). When the electrical connector is connected to the circuit board 7 (please refer to FIG. 4), the conductive layer 50' can be electrically connected to the grounding circuit 72 of the circuit board 7 via a conductive sheet 60'. Thus, it can achieve the effect as the same as the above embodiment. Furthermore, the process of mounting the shielding layers 30' on the outside of the insulating lumps 40' is easier than mounting the shielding layers 30' on the inner wall of the terminal-receiving holes 11'.

What is claimed is:

1. An electrical connector, comprising:

an insulating body having a plurality of terminal-receiving holes, each terminal-receiving hole being defined by an corresponding inner surface;

a plurality of shielding layers, being formed on the inner surfaces correspondingly;

a plurality of insulating layers formed on the shielding layers; and a plurality of terminals disposed in the terminal-receiving holes and near the insulating layers, wherein the insulating layers being between the shielding layers and the terminals.

2. The electrical connector as claimed in claim 1, wherein the shielding layers are metal housings disposed around the terminal-receiving holes.

3. The electrical connector as claimed in claim 1, wherein the shielding layers are metal films plated to the terminal-receiving holes.

4. The electrical connector as claimed in claim 1, wherein the shielding layers are foil attached to the terminal-receiving holes.

5. The electrical connector as claimed in claim 1, wherein the insulating layers are plastic layers that cover the shielding layers.

6. The electrical connector as claimed in claim 1, wherein the insulating layers are insulating coatings applied to the shielding layers.

7. The electrical connector as claimed in claim 1, wherein the insulating layers are plastic films that are attached to the shielding layers.

8. The electrical connector as claimed in claim 1, wherein the electrical connector further has a conductive portion that is electrically connected to the shielding layers in the terminal-receiving holes.

9. The electrical connector as claimed in claim 1, wherein the electrical connector is connected to a circuit board, and the conductive portion is connected to a grounding circuit of the circuit board.

* * * * *